US006111235A

United States Patent [19]

Ritter et al.

[11] Patent Number: 6,111,235

[45] Date of Patent: Aug. 29, 2000

[54] APPARATUS AND METHOD FOR COOLING THE BEARING OF A GODET FOR ADVANCING AND GUIDING YARN

[75] Inventors: Walter Ritter, Radevormwald; Rainald Voss, Wermelskirchen; Bernd Erhard Kummelt, Solingen, all of Germany

[73] Assignee: Barmag AG, Remscheid, Germany

[21] Appl. No.: 09/199,260

[22] Filed: Nov. 25, 1998

[30] Foreign Application Priority Data

Nov. 28, 1997 [DE] Germany ..... 197 52 932

[51] Int. Cl.[7] ..... H05B 6/14

[52] U.S. Cl. ..... 219/619; 219/632; 219/469; 242/18 AA; 384/900

[58] Field of Search ..... 219/619, 632, 219/469, 470; 242/18 R, 18 AA; 384/900

[56] References Cited

U.S. PATENT DOCUMENTS

| | | | |
|---|---|---|---|
| 3,601,968 | 8/1971 | Wirz | 219/619 |
| 4,005,302 | 1/1977 | Graf et al. | 219/619 |
| 4,822,972 | 4/1989 | Sugioka et al. | 219/619 |
| 5,324,905 | 6/1994 | Arnosti et al. | 219/619 |

FOREIGN PATENT DOCUMENTS

| | | |
|---|---|---|
| 0 349 829 | 1/1990 | European Pat. Off. . |
| 71 13 902 | 10/1971 | Germany . |
| 37 01 077 | 8/1987 | Germany . |

*Primary Examiner*—Philip H. Leung
*Attorney, Agent, or Firm*—Alston & Bird LLP

[57] ABSTRACT

In a godet for advancing and guiding an advancing synthetic filament yarn, the bearing housing for supporting a shaft consists of an inner bearing support and an outer cooling body, which are in a heat conducting contact with each other. Cooling of a bearing within the bearing support is enhanced because the material of the cooling body has a coefficient of thermal conduction which is greater than the coefficient of thermal conduction of the bearing support material. In a heated godet, a cup-shaped godet casing fits over the end of the shaft, and a stationary hollow cylindrical support is fit over the shaft within the godet casing. An annular space is defined between the support and the shaft, and a heating element is mounted to the circumference of the support. The bearing housing at least partially defines openings that provide cooling air to the annular space.

14 Claims, 4 Drawing Sheets

APPARATUS AND METHOD FOR COOLING THE BEARING OF A GODET FOR ADVANCING AND GUIDING YARN

BACKGROUND OF THE INVENTION

The invention relates to an apparatus and method for cooling the bearings of a godet for advancing and guiding an advancing yarn.

It is common to use, in particular in spinning machines operating at high delivery and takeup speeds, individual or groups of godets for guiding and advancing yarn, for example, in a draw zone. In this instance, the godets are typically equipped with an individual drive, which drives a shaft connected to a godet casing. Normally, the shaft is supported in a region between the godet casing and an electrical drive, such as is known, for example, from DE 37 01 077.

The currently attained yarn speeds of more than 1,000 m/min. require high-speed bearings which must operate at very high rotational speeds, and meet with an infinite service life. These enormous stresses lead to a relatively high heat energy in the electric drive as well as to a heating of the bearings. This gives rise to the problem that the operating temperatures of the bearings can be reached and exceeded very quickly.

In the known godet, the bearing bore is arranged directly in the wall of the machine frame that is constructed as a casing. However, this arrangement is not suitable for preventing the bearings from overheating.

EP 0 349 829 discloses a further godet, wherein the bearing housing is formed by a rotationally symmetric support. The support is arranged in a stationary housing. Likewise, this construction has the disadvantage that the heat generated in the bearing and emitted to the bearing housing can be dissipated only by heat conduction in a massive body.

The German Utility Model DE-GM 71 13 902 discloses a godet, wherein the bearings are cooled by air-cooled flow channels in the shaft and in the bearing housing. In this process, the air current is guaranteed by means of a fan wheel arranged on the shaft. This arrangement has the disadvantage that the hollow shaft must have a larger outside diameter in view of occurring stresses, so as to reach the strength of a solid cross section. However, this leads to still higher stresses of the bearings as a result of speed. A further disadvantage lies in the arrangement of the flow channels in the bearing housing. These flow channels do not facilitate an even radial heat dissipation.

It is accordingly an object of the present invention to further develop the above-described kind of a godet for advancing and guiding an advancing synthetic filament yarn such that the bearing housing facilitates a rapid and even heat dissipation from the region of the bearings.

SUMMARY OF THE INVENTION

The above and other objects and advantages of the present invention are achieved by the provision of a godet that comprises a two part bearing housing. The bearing housing comprises a bearing support having a circumference and defining at least one bearing bore, and a cooling body connected to the circumference of the bearing support for conducting heat away from the bearing support. The material of the cooling body has a coefficient of thermal conduction that is greater than the coefficient of thermal conduction of the material of the bearing support. A shaft is supported by a bearing that is mounted within the bearing bore. A cup-shaped godet casing is fit over and mounted to an end of the shaft that extends from the bearing, and an electric drive motor is connected to an opposite end of the shaft that extends from the bearing. The drive motor drives the shaft and the godet casing so that the godet casing can guide and advance a yarn.

The invention makes it possible to link together in the bearing housing the material characteristics of strength and heat conductivity which have a tendency to be opposite. Whereas the cooling body of the bearing housing is constructed of a material with very satisfactory heat conducting properties, the bearing support of the bearing housing, which is interior of the cooling body, ensures inherent stability as well as strength in the region of the bearing. The bearing support is connected essentially over its entire circumference with the cooling body in heat-conducting contact therewith. This arrangement has also the advantage that the cooling body supports the bearing support over its entire circumference. This makes it possible to construct the bearing support with minimal wall thicknesses, which ensures the necessary position tolerances for the bearings. Thus, the bearing forces are absorbed both by the bearing support and by the cooling body.

A particularly advantageous further aspect of the present invention results in a cooling of the shaft. The amount of heat dissipated from the electric drive motor or other sources may be introduced into the bearing or bearings of the godet by the way of the shaft. The formation of a narrow air gap between the shaft and the bearing housing permits minimization of the insulating layer which hinders the heat transfer between the shaft and the bearing housing.

In accordance with one embodiment of the invention, the air gap is defined within a shaft bore that is defined through the cooling body and receives the shaft. In accordance with another embodiment of the invention, the air gap is defined within a shaft bore that is defined through the bearing support and receives the shaft.

Regarding the embodiment where the shaft bore is defined through the bearing support, a single bearing support defines opposite first and second end sides. A first bearing bore is defined within the bearing support at the first end side, and a first bearing is mounted within the first bearing bore. Similarly, the bearing support further defines a second bearing bore that is at the second end side, and a second bearing is mounted within the second bearing bore. The bearing support comprises an inner surface that defines the shaft bore, and the shaft bore interconnects and is substantially concentric with the bearing bores. The shaft is supported by both of the bearings and extends through the shaft bore, so that the air gap is defined between the shaft and the inner surface of the bearing support.

In the embodiment where the air gap is defined by the bearing support, the heat transfer between the shaft and the bearing housing can be enhanced by defining a plurality of opening in the bearing support in the region of the shaft bore. The opening extend radially into the bearing support from the circumference of the bearing support, and the cooling body comprises a plurality of posts that fill the openings. In one embodiment the openings extend from the circumference of the bearing support to the shaft bore.

Regarding the embodiment where the shaft bore is defined through the cooling body, the bearing support consists of two separate annular bearing support segments. A first bearing support segment defines a first bearing bore, and a first bearing is mounted within the first bearing bore. A second bearing support segment defines a second bearing bore, and a second bearing is mounted within the second bearing bore. The cooling body comprises an inner surface that defines the shaft bore and the shaft bore interconnects and is substantially concentric with the bearing bores. The shaft is supported by both of the bearings and extends through the shaft bore, so that the air gap is defined between the shaft and the inner surface of the cooling body. Thus, it is possible to transfer directly into the cooling body a significant portion of the heat energy that radiates from the shaft.

In accordance with another aspect of the invention, the heat-releasing surface of the cooling body is enhanced by including axially extending cooling ribs on the circumference of the cooling body.

In accordance with another aspect of the invention, a cooling air current may be utilized for cooling the electric motor as well as the bearing housing. More specifically, the godet may further include a cup-shaped drive housing and a fan. The drive housing fits over and at least partially encloses the drive motor and is connected to the circumference of the cooling ribs. The fan is positioned within the drive housing and is operative to provide an axially directed air current that cools the drive motor and the cooling ribs.

Heated godets involve the additional problem that the projecting end of the shaft that carries the godet casing is heated by a heating device, which is arranged between the rotating godet casing and the shaft. This heat energy can lead to a further detrimental heating of the bearings.

In accordance with another aspect of the present invention, the detrimental heating of the shaft in a heated godet can be diminished. More specifically, the heated godet of the present invention comprises a bearing housing defining at least one bearing bore, and a shaft supported by a bearing mounted within the bearing bore. A cup-shaped godet casing is fit over and mounted to an end of the shaft that is distant from the bearing. An electric drive motor is operative for rotating the shaft and the godet casing so that the godet casing can guide and advance a yarn. A stationary, hollow cylindrical support is fit over the shaft within the godet casing. The support has a circumference and an annular space is defined between the support and the shaft. A heating element is mounted to the circumference of the support for heating the godet casing. Openings that are at least partially defined by the bearing housing provide a communication path between the annular space, which is between the support and the shaft, and the environment exterior to the godet casing. As a result, a cooling air current may flow into the annular space through the openings so that heating of the shaft by the heating element and heating of the bearing by the shaft is diminished. That is, a significant portion of the amount of heat which is released by the heater into the annular space between the support and the shaft is dissipated into the surroundings.

The rotation of the freely rotating godet casing causes development of a suction, which forms an air current that enters the annular space within the godet casing through the openings that are at least partially defined by the bearing housing. From the annular space, the air current flows along the interior of the godet casing toward the open end of the godet casing and exits into the environmental external to the godet casing. Tests have shown that with the use of an induction heater to heat the godet casing of a heated godet, the cooling effect of the air current that enters the annular space through the aforementioned openings leads to a temperature reduction in the shaft of about 30° C.

For the heated godet, cooling air that is generated for cooling the bearing housing can simultaneously be directed to the annular space. More specifically, a cooling air current can be axially directed through the entire godet.

A heated godet constructed as described above may further comprise axially extending cooling ribs that extend from the circumference of the cooling body. Additionally, a ridge may span transversely between adjacent cooling ribs so that a groove defined between the adjacent cooling ribs is divided into two subsections. The ridge advantageously impacts air circulation within the annular space.

To enhance the effectiveness of the cooling air current within the annular space, an insulating body is placed within the annular space between the shaft and the support.

BRIEF DESCRIPTION OF THE DRAWINGS

Further advantages and characteristics of the invention are described below in more detail with reference to the attached drawings, in which.

DETAILED DESCRIPTION OF THE PREFERRED EMBODIMENTS

Figure 1:
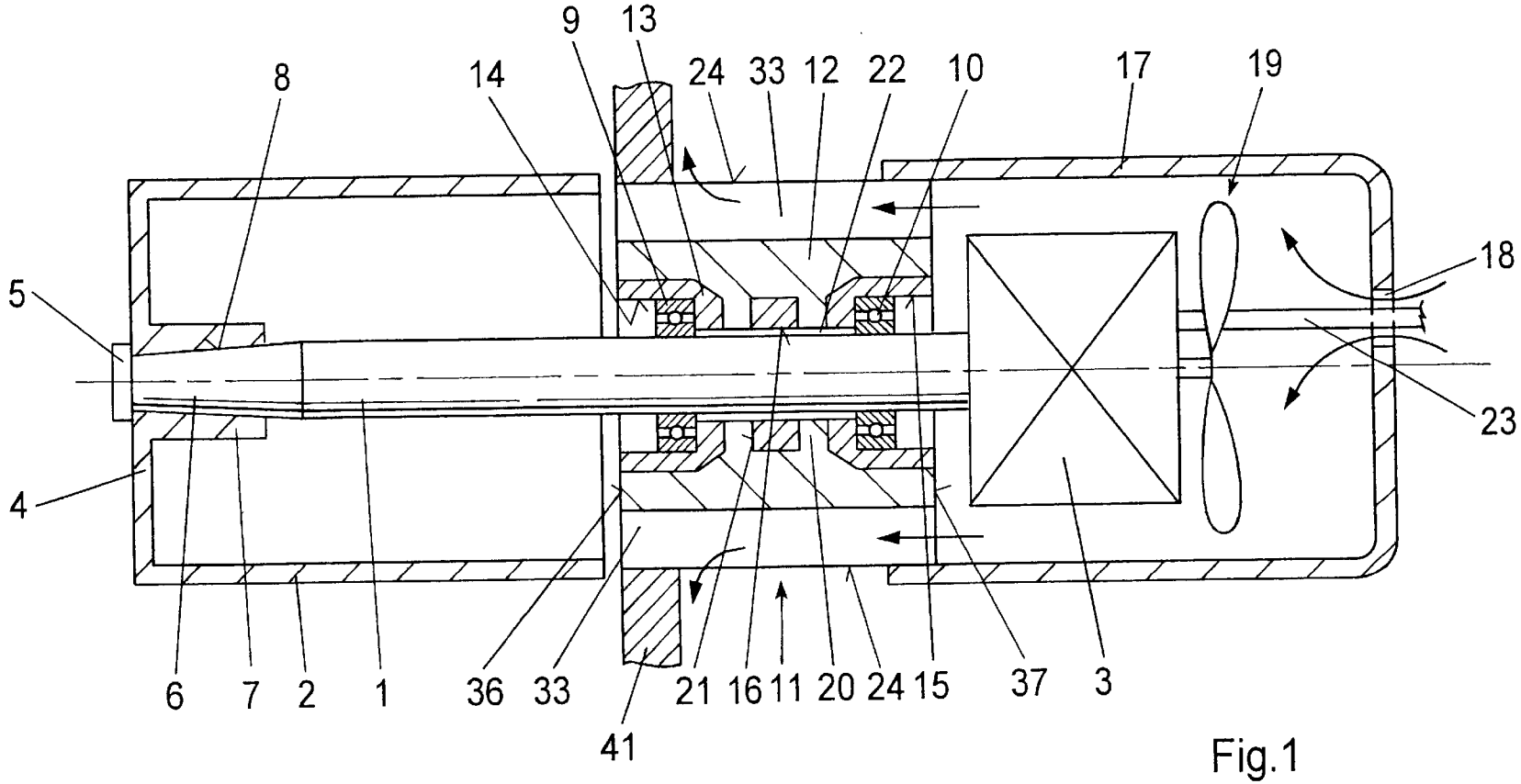
FIG. 1 is a schematic, axially sectioned view of a godet in accordance with a first embodiment of the invention.

FIG. 1 is a schematic, axially sectioned view of a godet in accordance with a first embodiment of the invention. The godet of the first embodiment consists of a godet casing 2. The godet casing 2 is cup-shaped and fit over a drive shaft 1. Mounted to the projecting end of shaft 1 is an end wall 4 of godet casing 2. The end wall 4 has a collar 7 concentric with godet casing 2. A bore 8 which conically enlarges at the free end of collar 7 extends through the end wall 4 and collar 7. Formed to the end of the projecting end of shaft 1 is a cone 6, which is form fittingly connected to the collar 7. A clamping element 5 tightly secures the end wall 4 with collar 7 to the cone 6 of shaft 1. At its opposite end, the shaft 1 connects to an electric motor 3. The electric motor 3 drives the shaft 1 and, thus, the godet casing 2.

In the region between the godet casing 2 and electric motor 3, the shaft 1, and thus the rotor of the electric motor, are supported in a bearing housing 11 by bearings 9 and 10. The bearing housing 11 consists of a bearing support 13 and a cooling body 12. At the end faces 36 and 37 of bearing housing 11, bearing bores 14 and 15 are arranged in the bearing support 13. Into bearing bores 14 and 15, the bearings 9 and 10 are fitted in such a manner that their outer races are held in the bearing support and their inner races are located on the shaft 1. The bearing bores 14 and 15 are interconnected via a shaft bore 16 arranged in the bearing support 13 substantially concentric therewith. The shaft bore 16 is dimensioned such that a narrow air gap 22 forms between the bearing support 13 and shaft 1.

Preferably, the bearing support 13 is made rotationally symmetric. On its periphery, the bearing support 13 is surrounded by cooling body 12, which is in a heat-conducting contact with bearing support 13. In the region of the shaft bore 16, the bearing support 13 is provided with several openings 21 distributed over its circumference. The opening 21 are filled with posts 20 of the cooling body 12, which are congruent in shape to the shape of the openings. This has the advantage that the heat transferring surfaces between the bearing support and the cooling body can be made relatively large. Furthermore, this allows the heat developed in shaft 1 to be transferred directly to the cooling body 12.

In the first embodiment, it is preferred to make the bearing support 13 of steel or cast metal. In comparison thereto, the cooling body 12 consists preferably of aluminum. Thus, it would be possible to make the bearing housing 11 shown in FIG. 1 in such a manner that the bearing support 13 is cast in a mold directly into a cooling body 12 consisting of cast aluminum.

As is commonly known, the thermal conductivity of aluminum or aluminum alloys lies in a range of 200 W/(m·K). Thus, the material is well suited for transporting thermal energy. Compared thereto, steel or cast iron have a thermal conductivity in the range of 50 W/(m·K). Thus, a bearing housing which is made entirely of steel or cast iron would dissipate four times less energy than a bearing housing of aluminum.

Figure 3:
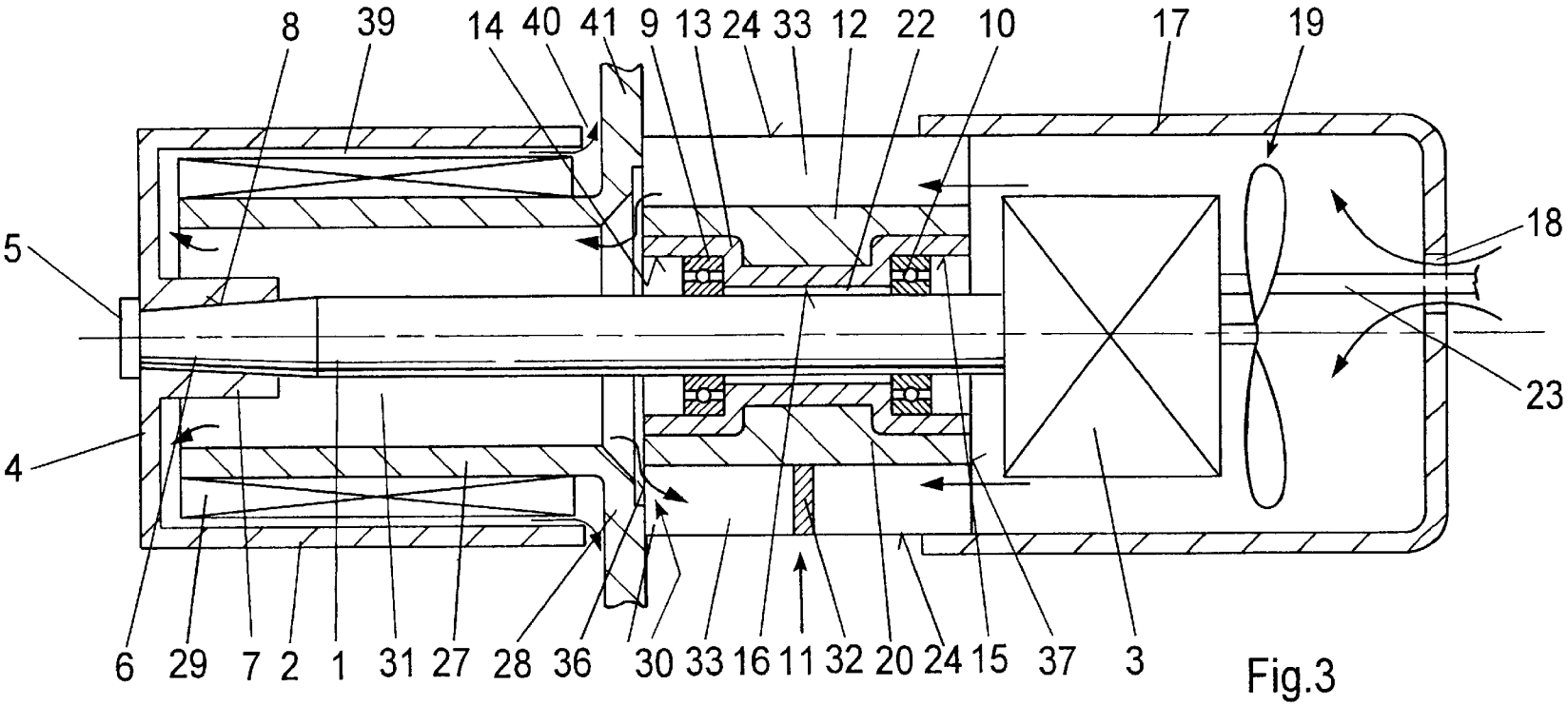
FIG. 3 is a schematic, axially sectioned view of a heated godet in accordance with a second embodiment of the invention.
Figure 4:
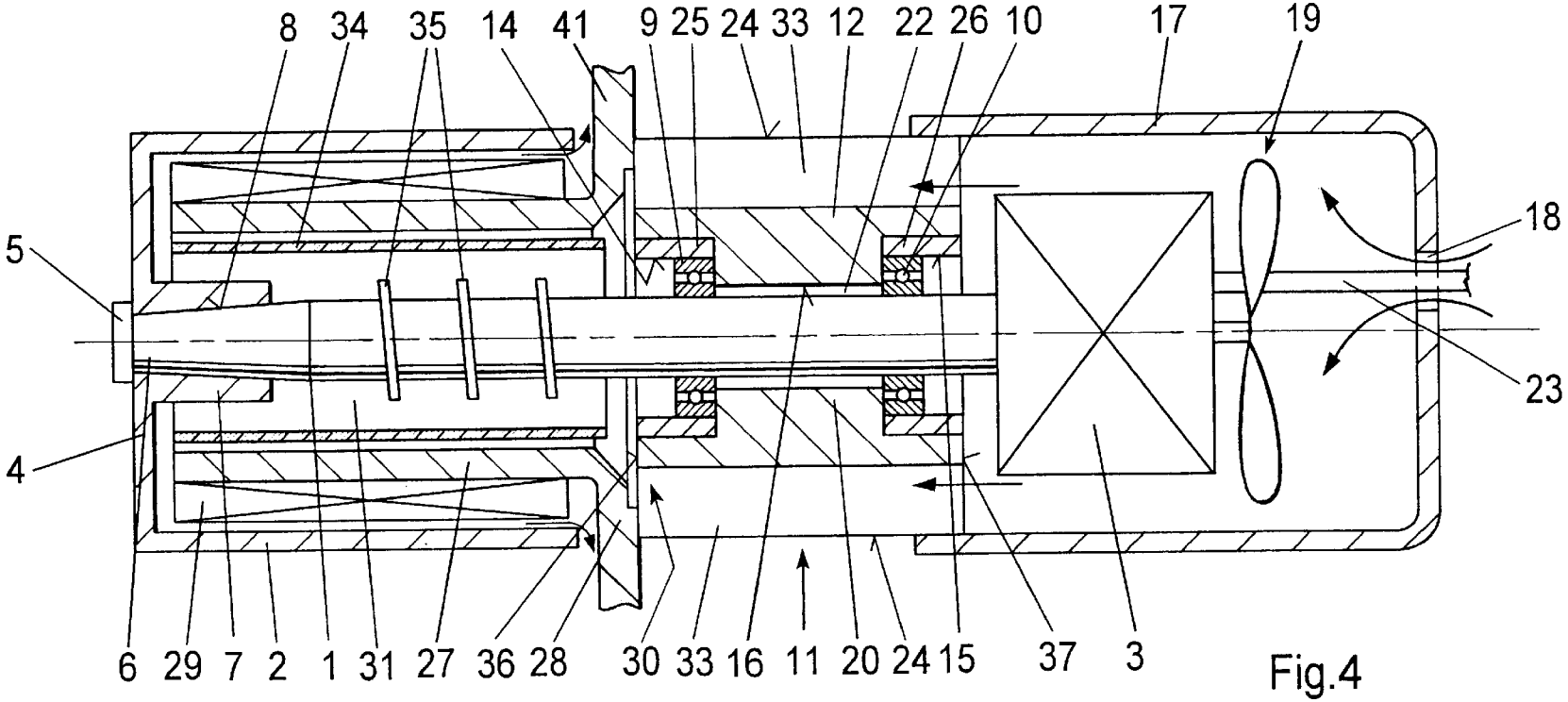
FIG. 4 is a schematic, axially sectioned view of a heated godet in accordance with a third embodiment of the invention.

The bearing support 13 of the first embodiment shown in FIG. 1 may also be constructed as a closed bushing, as shown in FIG. 3, which illustrates a second embodiment of the invention. In the case of an increased development of heat in the shaft 1, the bearing support of a third embodiment of the invention, which is illustrated in FIG. 4, will be of advantage. In the third embodiment, the bearing support consists of two support segments 25 and 26. The support segments 25 and 26 are each inserted into the cooling body 12 respectively on the end sides 36 and 37. The bearing bores 14 and 15 are respectively formed in support segments 25 and 26. The region between the support segments 25 and 26 is filled right to the shaft bore 16 by the cooling body 12. That is, in the region between the support segments 25 and 26, the shaft bore 16 is defined by the cooling body 12.

Referring back to FIG. 1, formed to the circumference of cooling body 12 are a plurality of cooling ribs 24 which extend in the axial direction of the godet, so that a cooling groove 33 forms respectively between two adjacent cooling ribs 24. As a result of the cooling ribs 24, the surface of the cooling body 12 that is used for dissipating thermal energy to the surroundings is considerably increased.

On the periphery of cooling ribs 24, the end of cooling body 12 facing godet casing 2 mounts a flange 41 which is firmly connected to the cooling ribs 12. The flange 41 is used to mount the godet to a machine frame. FIG. 1 shows only a partial section of flange 41.

In the embodiment of the godet as shown in FIG. 1, a drive casing 17 enclosing electric motor 3 is arranged on the drive side of bearing housing 11. The drive housing 17 is connected on the periphery of cooling ribs 24 to the bearing housing 11. On the side of the electric motor 3 facing away from shaft 1, a fan 19 is arranged which is likewise driven via the electric motor 3. The fan 19 is integrated in drive housing 17. The drive housing 17 has on its closed end side an opening 18, through which energy is supplied to the electric motor 3 via a line 23. In the drive housing 17, the fan 19 generates a cooling air current which enters from outside via opening 18 into the drive housing and passes by the electric motor 3. In this connection, it may also be advantageous to arrange the housing of electric motor 3 on the cooling body 12. Subsequently, the cooling air current indicated by arrows in FIG. 1 reaches cooling grooves 33 of cooling body 12 and flows in axial direction along cooling ribs 24. As a result, the heat dissipation of cooling body 12 to the surroundings is substantially increased.

Figure 2:
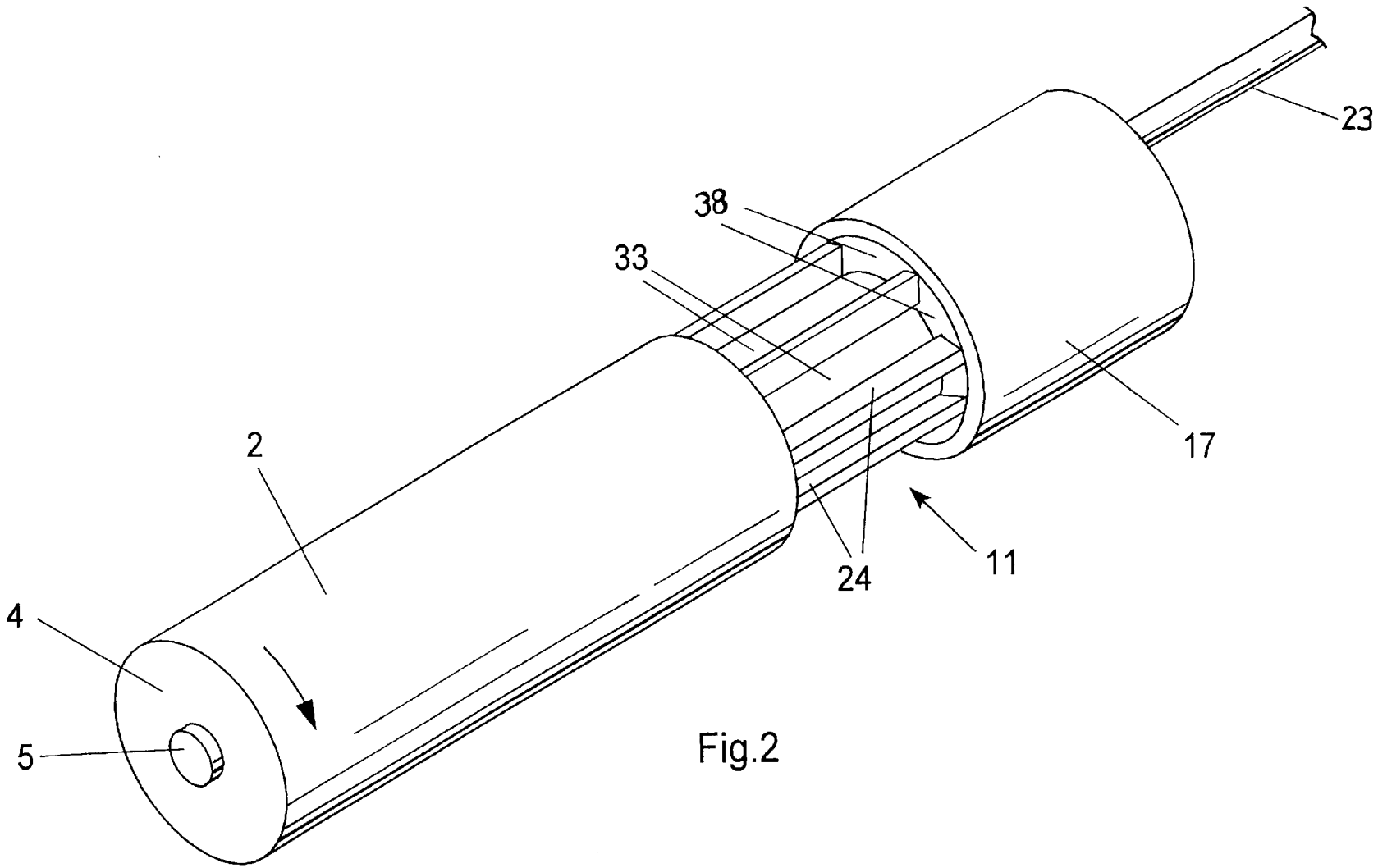
FIG. 2 is a perspective view of the godet of FIG. 1.

FIG. 2 is a perspective view of the godet of FIG. 1, omitting the illustration of flange 41. The bearing housing 11 is made rotationally symmetric. On the drive side, the drive housing 17 is mounted to the periphery of cooling ribs 24. Between the cooling body 12 and drive housing 17, a plurality of outlet openings 38 distributed over the circumference are formed, which terminate in cooling grooves 33. The godet casing 2 is connected to the shaft via end wall 4 by means of clamping element 5, and driven in the direction of rotation indicated by arrows. The electric motor 3 is supplied with energy via line 23. Such godets are installed, for example, directly in machine frames. To this end, it will be advantageous when a peripheral flange 41 (FIG. 1) is arranged on the cooling ribs 24 for mounting to the machine.

Two embodiments of a heated godet are shown in FIGS. 3 and 4. In these figures, structural components of like function are provided with like numerals. The arrangement of godet casing 2, shaft 1, electric motor 3, bearing housing 11, and drive housing 17 is substantially identical with that shown in FIG. 1. To avoid repetitions, the description of FIG. 1 is herewith incorporated by reference.

In the embodiments of FIGS. 3 and 4, a hollow cylindrical support 27 is slipped over the shaft 1 in the region within the godet casing 2. On the side of support 27 facing the bearing housing 11 a collar 28 is formed which merges into a flange 41. The collar 28 and flange 41 may consist of one part or, preferably, of several parts. The collar 28 is connected to cooling ribs 24 on the periphery thereof. In this connection, the collar 28 is shaped such that openings 30 are formed in the region of the cooling grooves 33 between the bearing housing 11 and the collar 28. The openings 30 connect an annular space 31 formed between shaft 1 and support 27 to the cooling grooves 33. Arranged on the circumference of support 27 is a heating element 29 that extends substantially over the length of the godet casing 2. The heating element 29 is preferably formed by electric coils which make it possible to heat the godet casing 2 by means of induction.

To prevent the heat that develops in the heating element 29 from dissipating into the shaft 1, the openings 30 formed on the periphery of the bearing housing 11 form an air flow that is generated by the rotation of the godet casing 2. In this connection, ambient air is sucked into the annular space 31 and guided via an annular gap 39 formed between the heating element 29 and the rotating godet casing 2 to an annular opening 40 formed in the open end of the godet casing.

To realize an air exchange or a circulation of the cooling air inside the annular space 31, a partial range of the cooling grooves 33 in the godet shown in FIG. 3 is divided in two subsections by ridges 32 that extend crosswise on the circumference of the cooling body 12 between the cooling ribs 24. As a result, the axial cooling air current that is generated by the fan 19 is unable to flow over the entire circumference evenly into the annular space 31. In the region where the cooling grooves 33 are divided by the ridge 32, the axial cooling air current generated by the fan 19 is diverted to the outside. This enhances the cooling air current that is circulated in the annular space 31. As a result of this measure, the air circulation within the annular space 31 is further increased.

In the embodiment of FIG. 4, a hollow cylindrical insulating body 34 is slipped over the shaft 1 in the annular space 31. The insulating body 34 extends substantially over the entire length of support 27, thereby forming in addition a heat shield between shaft 1 and support 27. Furthermore, the shaft 1 mounts a plurality of displacer elements 35, which extend into the annular space 31. The displacer elements are designed such that they generate an axially directed cooling air current during the rotation of shaft 1. This arrangement is suitable in particular with the use of heating coils 29, so as to be able to cool not only the shaft but also the coils.

The rotationally symmetric embodiments of the bearing housings 11 as shown in FIGS. 1–4, are only examples. The invention is not limited to rotationally symmetric bodies. The bearing housing may therefore have a contour that deviates from the rotationally symmetric shape.

That which is claimed is:

1. A godet assembly for guiding and advancing a yarn, comprising:

a bearing housing comprising:

a bearing support having an external circumference and defining at least one internal bearing bore, and a cooling body surrounding in heat exchange engagement the entire external circumference of the bearing support for conducting heat away from the bearing support, wherein the material of the cooling body has a coefficient of thermal conduction that is greater than the coefficient of thermal conduction of the material of the bearing support;

a bearing mounted within the bearing bore;

is a shaft supported by the bearing and having opposite first and second ends that are distant from the bearing;

a cup-shaped godet casing that is fit over and mounted to the first end of the shaft; and a drive connected to the shaft proximate to the second end, and operative for rotating the shaft and the godet casing so that the godet casing can guide and advance the yarn.

2. The godet assembly as defined in claim 1 wherein said bearing support defines opposite first and second end faces, wherein said one internal bearing bore is located at the first end face, wherein said bearing support defines a second internal bearing bore located at the second end face, wherein a second bearing is mounted within the second bearing bore and further supports said shaft, wherein said one internal bearing bore and said second internal bearing bore are interconnected by a tubular member which defines a shaft bore which is concentric with and of smaller diameter than the one and the second internal bearing bores, and wherein a narrow air gap is formed between the shaft and the shaft bore.

3. The godet assembly as defined in claim 2 wherein the tubular member of the bearing support includes a plurality of radial openings, and wherein the cooling body includes integral posts which fill said openings respectively.

4. The godet assembly as defined in claim 3 wherein said radial openings extend through the tubular member so as to communicate with the air gap formed between the shaft and the shaft bore.

5. The godet assembly as defined in claim 1 wherein said bearing support defines opposite first and second end faces and comprises a first annular support segment adjacent the first end face and which defines said one internal bearing bore, and a second annular support segment adjacent the second end face and which defines a second internal bearing bore, and wherein a second bearing is mounted within the second bearing bore and further supports said shaft.

6. The godet assembly as defined in claim 5 wherein the one and the second internal bearing bores are interconnected by a shaft bore that is substantially concentric with and of smaller diameter than the one and the second internal bearing bores, and wherein a narrow air gap is formed between the shaft and the shaft bore.

7. The godet assembly as defined in claim 1 wherein cooling body of the bearing housing includes axially directed external cooling ribs.

8. The godet assembly as defined in claim 7 wherein the cooling ribs define a circumference, and further comprising a drive housing connected about the circumference of the cooling ribs proximate to the second end of said shaft, and a fan mounted within the drive housing to provide an axially directed air current along the cooling ribs.

9. The godet assembly as defined in claim 8 further comprising a hollow tubular support fixedly mounted within the godet casing so as to coaxially surround the shaft in a spaced apart arrangement and define an annular space between the shaft and the support, a heating element mounted upon said support for heating the godet casing, and at least one opening that is at least partially defined by the cooling body of the bearing housing which provides communication between the annular space and the outside environment.

10. The godet assembly as defined in claim 9 wherein said at least one opening comprises opening means which is distributed about the circumference of the bearing housing and which communicates with the space between adjacent cooling ribs, and so that the axially directed air current at least in part enters said opening means and passes into said annular space.

11. The godet assembly as defined in claim 10 further comprising a ridge positioned between at least one pair of adjacent cooling ribs so as to control the axially directed air current.

12. The godet assembly as defined in claim 10 further comprising a tubular insulating body positioned between the shaft and the tubular support.

13. The godet assembly as defined in claim 10 further comprising at least one air displacing member mounted on said shaft and extending into said annular space.

14. The godet assembly as defined in claim 8 wherein said drive comprises an electric motor connected to the shaft and positioned within said drive housing, and wherein said fan is mounted so as to cause the air current to flow across the electric motor and then along the cooling ribs.

* * * * *